US007686566B1

(12) United States Patent
Murphy

(10) Patent No.: US 7,686,566 B1
(45) Date of Patent: Mar. 30, 2010

(54) METHOD OF USING A LIFTING HOIST

(76) Inventor: Patrick Arthur Murphy, 432 E. St. Peter St., New Iberia, LA (US) 70500

( * ) Notice: Subject to any disclaimer, the term of this patent is extended or adjusted under 35 U.S.C. 154(b) by 0 days.

(21) Appl. No.: 12/148,841

(22) Filed: Apr. 23, 2008

Related U.S. Application Data

(62) Division of application No. 10/933,610, filed on Sep. 2, 2004, now Pat. No. 7,424,932.

(51) Int. Cl.
*E06G 7/00* (2006.01)

(52) U.S. Cl. ..... 414/800; 182/103

(58) Field of Classification Search ..... 414/800; 182/10, 103; 187/10
See application file for complete search history.

(56) References Cited

U.S. PATENT DOCUMENTS

| | | | | |
|---|---|---|---|---|
| 156,541 | A * | 11/1874 | Conrad et al. | 187/241 |
| 651,665 | A | 6/1900 | Johns | |
| 938,986 | A * | 11/1909 | Danbridge | 187/241 |
| 976,240 | A | 11/1910 | Winkler | |
| 2,714,434 | A | 8/1955 | Peterson | |
| 2,942,693 | A | 6/1960 | Johnson | |
| 3,115,211 | A | 12/1963 | Ostrander, Jr. | |
| 3,666,054 | A | 5/1972 | Ellings et al. | |
| 3,799,289 | A | 3/1974 | Cecere, Jr. | |
| 4,183,423 | A | 1/1980 | Lewis | |
| D260,754 | S | 9/1981 | Gunnels | |
| 4,546,853 | A | 10/1985 | Hanson | |
| 4,550,806 | A | 11/1985 | Bocker | |
| 4,972,922 | A * | 11/1990 | Levine | 182/45 |
| 5,275,256 | A | 1/1994 | Ellzey | |
| 5,320,194 | A | 6/1994 | Bredijk | |
| 5,544,718 | A | 8/1996 | Schummacher | |
| 5,595,410 | A | 1/1997 | Wilson et al. | |
| 5,911,287 | A | 6/1999 | Campbell | |
| 6,244,381 | B1 | 6/2001 | Ruble | |
| 6,912,938 | B2 | 7/2005 | Kurtz | |
| 2003/0230451 | A1 | 12/2003 | Garrett | |

OTHER PUBLICATIONS

Grand Rental Station, website, http://rental.trusite.com/rental, 2003, Richmond, VA.

Bishop Ladder Company, website, http://bishopladder.com/hoists, Hartford, CT.

(Continued)

*Primary Examiner*—Charles A Fox

(57) ABSTRACT

A hoisting device and method for hoisting material up an extension ladder. The device includes a load-carrying carriage having a wheel and roller axle assembly that also serves as rollers for engagement with the rails of the ladder. The wheel and roller axle assembly allows the cart to transition from the ladder rails to the roof surface. Also provided is a dual braking means that serves to prevent the carriage from rolling back down the ladder or off of the roof in cases of cable malfunction. The method employs a hoisting mechanism having a removable winch used in conjunction with a releasable coupled pull cable that is brought to the roof surface on the carriage, detached from the carriage, mounted on the roof and used to return the carriage to and from the roof during hoisting operations. An adjustable ladder support is provided to support the ladder during a hoist.

15 Claims, 11 Drawing Sheets

OTHER PUBLICATIONS

Marathon Roofing Products, catalog, LPH Ladder Platform Hoists, Buffalo, NY.

Roofing Contractor, Magazine—advertisement, Oct. 2003, p. 76.

Clairco, website, http://www.equip-mathieu, corn, Quebec, Canada.

* cited by examiner

METHOD OF USING A LIFTING HOIST

This application is a divisional application of prior application Ser. No. 10/933,610 filed Sep. 2, 2004, now U.S. Pat. No. 7,424,932, the entire content of which are hereby incorporated by reference.

FIELD OF INVENTION

The present invention relates to hoisting devices. Particularly it pertains to a new lifting device used in conjunction with a ladder, and a method for raising construction materials onto the roof of a building.

BACKGROUND OF INVENTION

Construction workers are often called upon to transport construction materials and equipment onto the roof portion of a building. The materials may include roofing shingles, plywood sheets, bricks, ventilation units or even ornamental structures. Various lifting devices have been employed to accomplish this task. Such devices often require multiple persons to operate, have limited safety features and are often quite expensive to purchase and maintain.

Applicant proposes a load lifting system used in conjunction with a ladder, and a method to move a load to the roof of a building. The system is comprised of a carriage that rolls along the rails of conventional extension ladders and a self-contained hoisting mechanism for raising a load to the roof surface of a building.

The carriage of Applicant's lifting system includes a dual braking mechanism that reduces the risk of a loaded carriage sliding or rolling down the ladder during a lift or off of the roof once the load is brought to the roof surface. Applicant's lifting system also includes ladder rail adaptors to provide for a smooth transition of the carriage as it rolls along the rails of extension ladders and an eave adaptor to provide for a smooth roll surface between the ladder rails and the roof surface. The proposed lifting system also includes an infinitely adjustable ladder support to provide an intermediate support to the extension ladder.

SUMMARY OF INVENTION

The present invention provides a hoisting system for use in conjunction with a ladder, and a method to lift loads to a roof surface. The device is primarily intended to lift materials to the surface of pitched roofs typically used in residential construction. The device may also be employed to raise loads to flat or substantially flat roofs or to various levels of a wall during its construction and it may be of particular use in the construction of masonry walls.

The hoisting system is comprised of a load-bearing carriage having a roller axle and wheel assembly that allows the loaded carriage to roll up the rails of a ladder on its axels and then roll along a roof surface on the provided wheels to a desired unloading area. A rail guide is provided to maintain alignment of the carriage as it travels on the ladder rails.

A self-contained hoisting means is provided to roll the carriage along the ladder rails and along the roof surface. The hoisting means includes a roof anchor mechanism that adapts to the pitch of the roof in which it is used and thus allows for its employment on roofs having a variety of different roof slopes. The hoisting means is further comprised of a winch mechanism and pull cable arrangement having a support that works in cooperation with the roof anchor mechanism.

The carriage is further provided with a dual breaking mechanism as a safety device. The first breaking mechanism is comprised of a breaking bar that slides over the ladder rungs during a lift up the ladder but provides a positive stop against a ladder rung in the event of an untoward reversal of the carriage during the lift. The second breaking mechanism is comprised of elongated spikes that dig into the roofing surface and serve to hold the carriage on the roof in the event of an untoward reversal of the carriage while it is on a roofing surface.

Adaptors are provided for the ladder rails to allow for a smooth transition of the carriage between ladder rail extensions and from the ladder rails to the roof surface.

An infinitely adjustable ladder support is provided to give support to the extension ladder a point between its ends. This allows the user of the device to reduce the angle of the lift and as a consequence increase the lift capacity of the hoisting device.

DRAWINGS

Reference Numerals

| | | | |
|---|---|---|---|
| 10 | Lifting Hoist System | 12 | Carriage |
| 14 | Hoisting Assembly | 16 | Winch Assembly |
| 18 | Roof Anchor | 20 | Winch Cable |
| 22 | Ladder | 23 | Ladder Rail |
| 23A | Ladder Extension Rail | 24 | Ladder Rungs |

-continued

| | | | |
|---|---|---|---|
| 25 | Ladder Support | 26 | Carriage Frame |
| 27 | Carriage Deck Assembly | | |
| 27A | First Deck Portion | 27B | Second Deck Portion |
| 28 | Carriage Deck Hinge | 29 | Deck Load Support Bar |
| 29A | Load Support Bar Adjustment Screw | 30 | Carriage Axle |
| 30A | Axle Bearing | 32 | Carriage Axle |
| 32A | Axle Bearing | 34 | Carriage Wheel |
| 36 | Carriage load stop | 38 | Lower Load Stop Frame |
| 40 | Lower Load Stop Frame Columns | 42 | Upper Load Stop Frame |
| 44 | Upper Load Stop Columns | 46 | Load Stop Brace |
| 46A | Load Stop Brace Support | 48 | Load Stop Adjustment Screw |
| 50 | Carriage Brake Assembly | 52 | Ladder Rung Brake Bar |
| 54 | Carriage Ladder Brake bearing | 56 | Carriage Ladder Brake Rung Stop |
| 58 | Carriage Roof Brake Assembly | 60 | Carriage Roof Brake Claw |
| 62 | Carriage Roof Brake Bearing | 64 | Carriage Ladder Brake Support Pins |
| 66 | Carriage Brake Engagement Lever | 68 | Brake Engagement Lever Bearing |
| 69 | Brake/Carriage Deck Latch | 70 | Carriage Hitch Bar |
| 71 | Carriage Hitch Ring | 72 | Rail Guide Assembly |
| 74 | Rail Guide | 75 | Rail Guide Adjustment plate |
| 76 | Rail Guide Adjustment Slot | 78 | Rail Guide Adjustment Screw |
| 80 | Winch | 81 | Winch spool |
| 82 | Winch Support Frame | 83 | Cable Guide |
| 84 | Winch Support Roof Anchor Stops | 85 | Winch Support Carriage Hitch |
| 86 | Roof Anchor Bar | 86A | Roof Anchor legs |
| 86B | Roof Anchor legs | 87 | Roof Anchor Winch Supports |
| 88 | Roof Anchor Cable Hitch | 89A | Roof Anchor Pad |
| 89B | Roof Anchor Pad | 90 | Roof Anchor Pad Bearing |
| 91 | Roof Anchor Spike Guide | 92 | Ladder Roof Eave Guide Bar |
| 93 | Eave Guide Bar Attachment Tab | 95 | Eave Guide Bar Bolt |
| 96 | Ladder Extension Rail Transition Assembly | | |
| 97 | Ladder Transition Rail | 98 | Ladder Transition Rail Support Plate |
| 98A | Transition Rail Filler Plate | 99 | Ladder Transition Support Plate Bolt |
| 101 | Ladder Support Base | 102 | Ladder Base Legs |
| 103 | Ladder Support Pole | 103A | Lower Support Pole Segment |
| 103B | Upper Telescoping Support Pole Segment | | |
| 104 | Ladder Support Adjustment Clamp | 104A | Ladder Support Adjustment Clamp |
| 104B | Ladder Support Spring | 104C | Ladder Support Spring Stop |
| 105 | Ladder Rung Support Bar | 106 | Ladder Rung Cradle |
| 200 | Building | 210 | Roof |

DETAILED DESCRIPTION OF THE INVENTION

Figure 1:
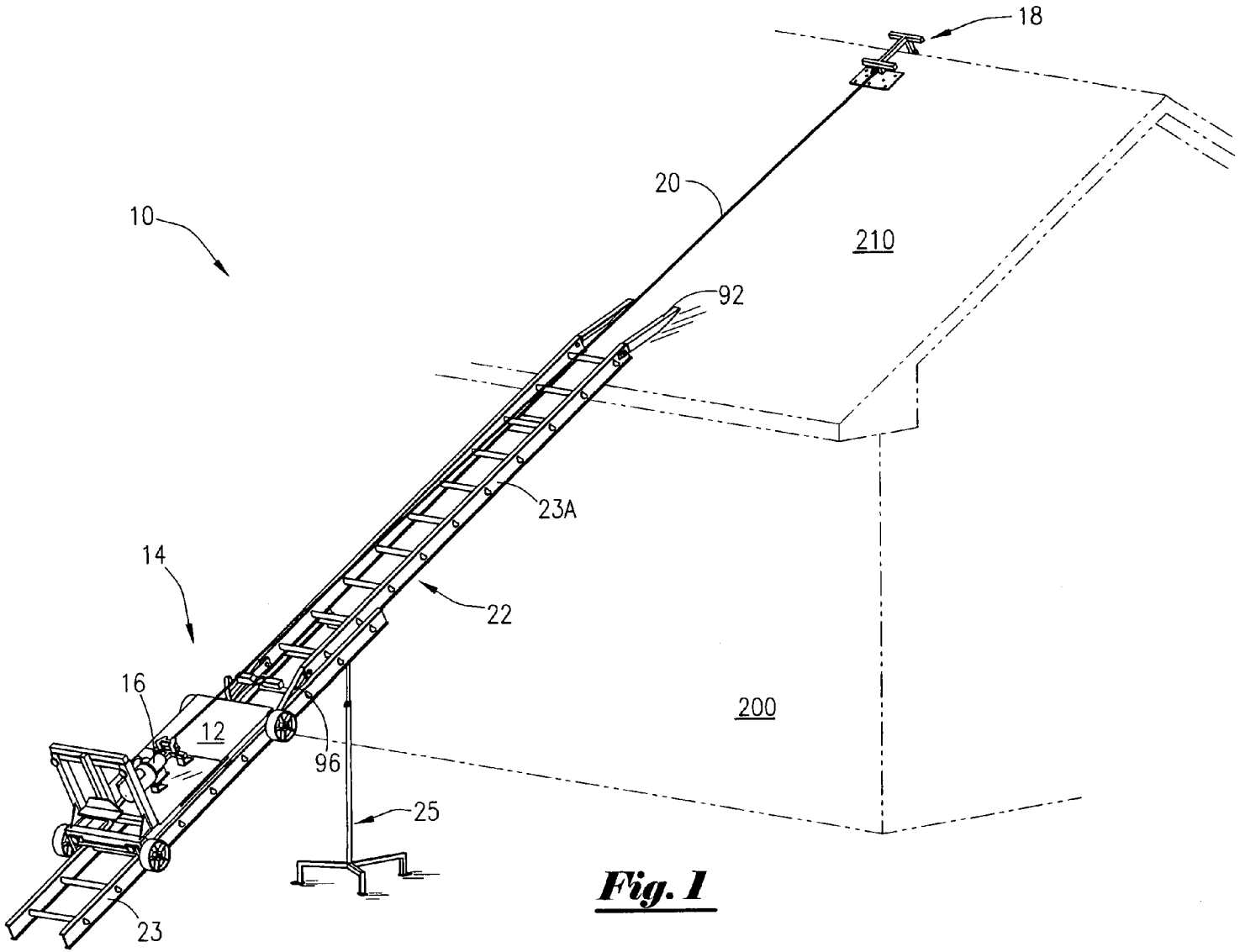
FIG. 1 is a perspective view of the ladder hoisting assembly.

Referring now to the drawings and more particularly FIG. 1, there is shown a prospective view of the hoisting system 10 of applicant's invention. The hoisting system 10 is typically used to lift materials from the ground or from a truck bed onto the roof of a building 200. The system 10 is comprised of a hoisting assembly 14 used to hoist loads up a ladder 22 that extends to the roof 210 of the building 200. The ladder 22 is shown as an extension ladder having lower ladder rails 23 and upper ladder extension rails 23A, though single section, non-extending, ladders may also be utilized. As may be required, the extension ladder 22 may be supported as desired by a telescoping ladder support 25.

The hoisting assembly 14 is comprised of a carriage 12 that rolls along and is supported by the rails 23 and 23A of the ladder assembly. A winch assembly 16 having a winch cable 20 is used, in conjunction with a roof anchor 18 attached to the ridge of the roof 210, to roll the carriage 12 along the ladder 22 to the roof 210.

Figure 2:
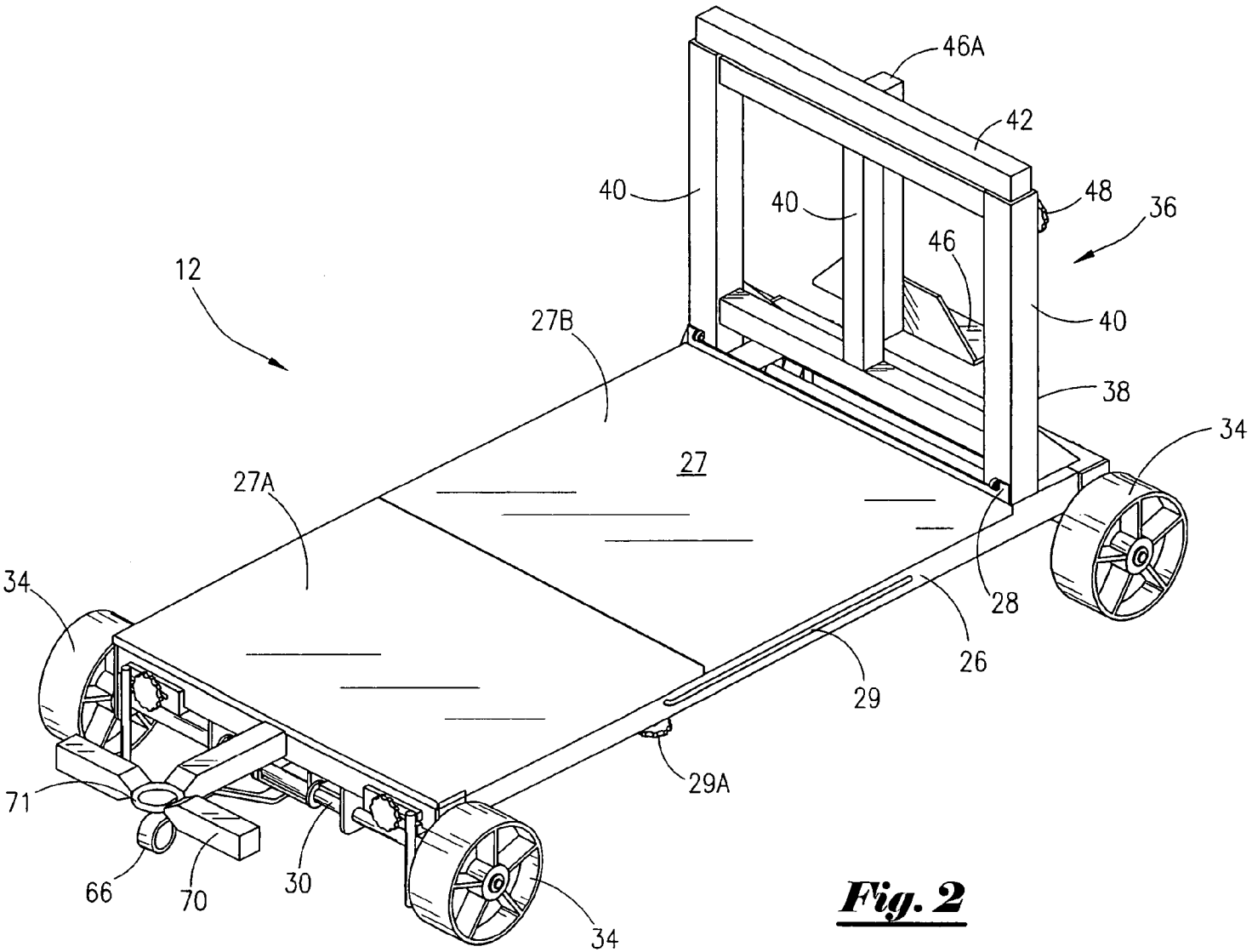
FIG. 2 is a perspective top view of the ladder hoist carriage.
Figure 3:
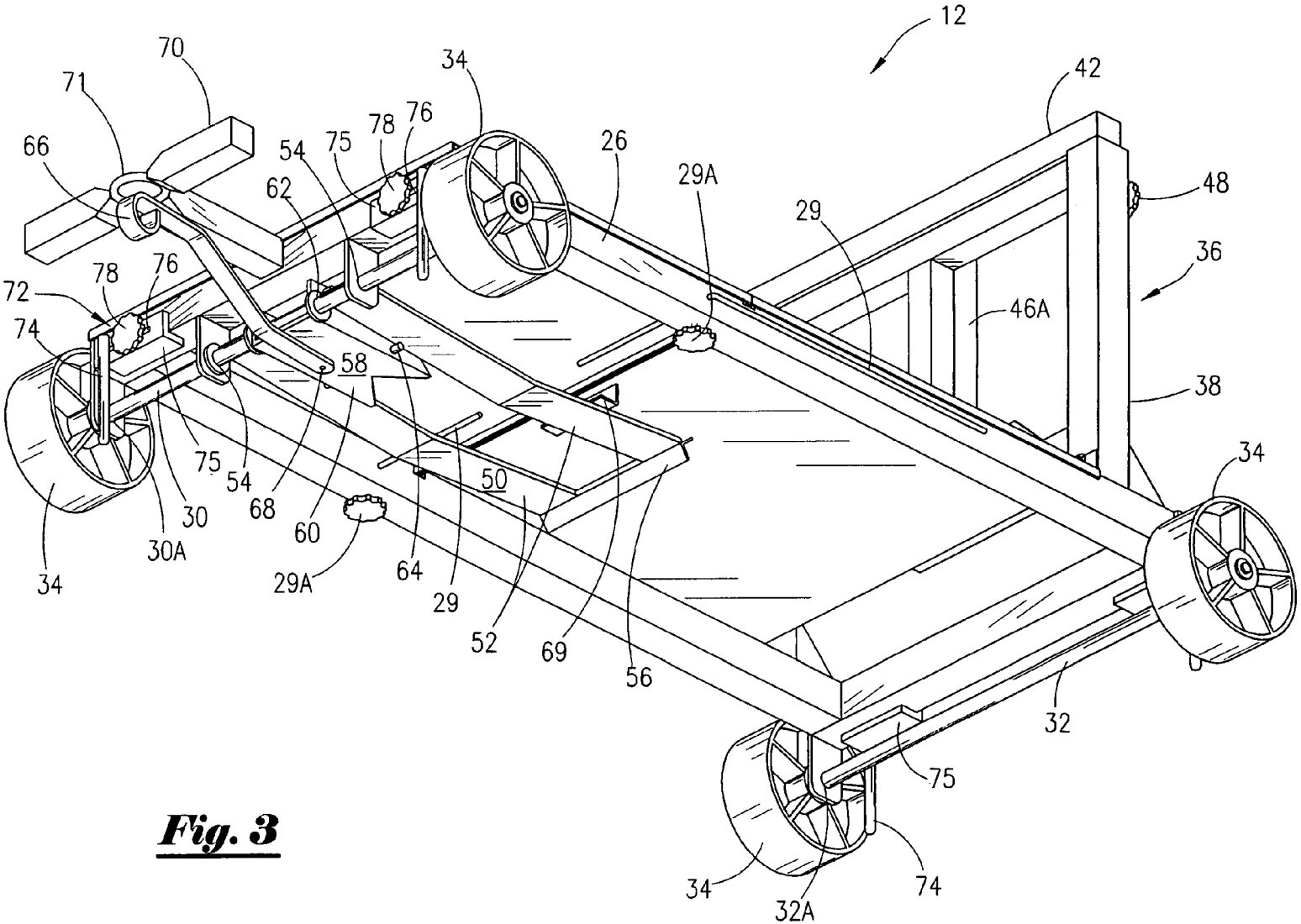
FIG. 3 is a perspective bottom view of the ladder hoist carriage.

FIG. 2, a top prospective view of the carriage 12, and FIG. 3, a bottom prospective view of the carriage 12 show the components of the carriage 12. The carriage 12 is comprised of a frame 26 having carriage axles 30 and 32 supported on axle bearings 30A, 32A for rollably supporting the carriage 12 on the rails 23 and 23A of the extension ladder 22. Each carriage axle 30, 32 has carriage wheels 34 that allow the carriage 12 to be rolled along the roof surface 210 when the carriage transitions from the rails 23, 23 A of the ladder 22 to the roof surface 210.

A carriage deck assembly 27 is supported on the frame 26. The carriage deck assembly 27 has a first deck portion 27A a second deck portion 27B. These deck portions 27A and 27B are pivotally attached to the carriage frame 26 by means of carriage deck hinges 28. To minimize load shifting during a lift the carriage 12 is provided with a deck load support bar 29 adjustably mounted to the frame 26 by means of a load support bar adjustment screw 29A.

The carriage 12 has a carriage load stop 36 which is comprised of a lower load stop frame 38 having tubular lower load stop frame columns 40 and an upper load stop frame 42 having upper load stop columns 44 that slidably fit into the tubular support columns 40 and held in place by means of adjustment screw 48. This arrangement allows for telescopic adjustment of the height of the load stop 36. The load stop 36 has a load stop brace 46 mounted on load stop brace support 46A attached to the upper load stop frame 42. The upper load stop frame 42 may be reversed to position the load support brace 46 atop a load carried on the deck surface 27.

The carriage 12 is provided with a carriage hitch bar 70 mounted to the frame 26 of the carriage 12. The carriage hitch bar 70 has a carriage hitch ring 71 for attachment of the cable 20 from the winch assembly 16.

Referring to FIG. 3, the carriage brake assembly 50 is shown below the deck 27 of the carriage 12. The carriage brake assembly 50 is comprised of a ladder rung brake bars 52 having an upwardly canted configuration that pivots about the axle 30 by means of a ladder brake bearing 54. This pivotal mounting allows the brake bar 52 to slide over ladder rungs 23, 23A as the carriage 12 is pulled up the ladder 22. The ladder brake bars 52 support a ladder brake rung stop 56 at their ends. The rung stop 56 will slide over the ladder rungs 23 and 23A during a lift but will fall down to engage a ladder rung 24 in the event the carriage 12 rolls down the ladder 22 during the hoisting of a load.

The carriage brake assembly 50 also includes a roof brake assembly 58. The roof brake assembly 58 is comprised of a roof brake claw 60 that is pivotally mounted on the axle 30 between the ladder rung brake bars 52 by means of roof brake bearings 62. Upper and lower carriage ladder support pins 64 attached to the claw 60 impede the full rotation of the roof brake claw 60 on the axle 30. The pins 64 engage the brake bars 52 and allow the carriage brake claw 60 to dig into a roof surface when the carriage 12 rolls down a roof surface.

The carriage brake assembly 50 and roof brake assembly 58 are engaged and disengaged by means of a brake engagement lever 66 that pivots on a brake engagement lever bearing 68 mounted on the roof brake claw assembly 58. When the brake assembly is disengaged the lever 66 is upwardly biased against the carriage hitch bar 70. To engage the braking system prior to making a lift, the engagement lever 66 is pivoted off of the hitch bar 70 to allow the claw 60 of the roof brake assembly 58 and the brake bars 52 of the carriage brake assembly 50 to freely pivot on the axle 30.

Figure 9:
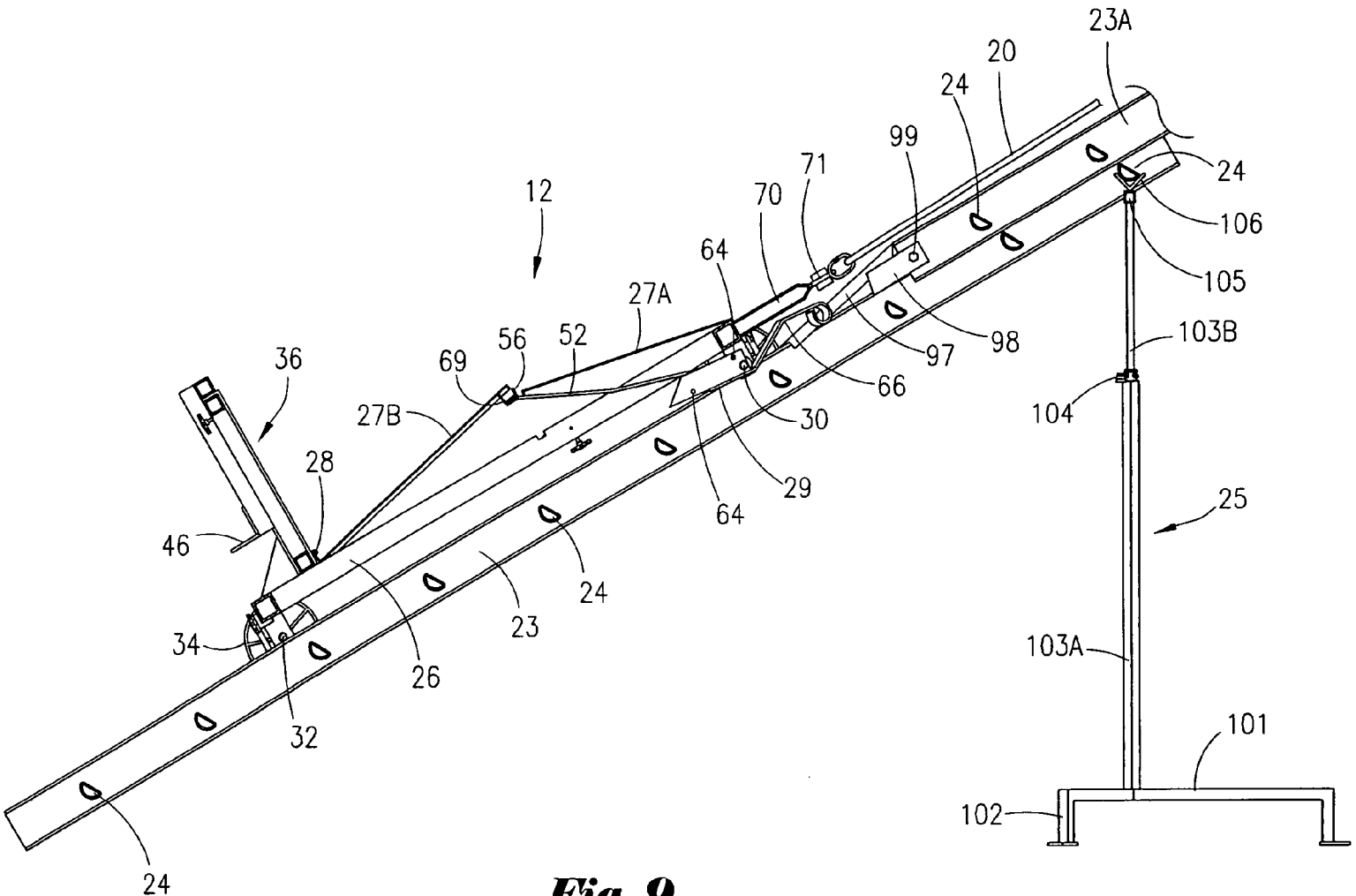
FIG. 9 is a cross sectional view of the hoisting apparatus.

The carriage brake assembly 50 and roof brake assembly 58 can also be completely disengaged, as shown in FIG. 9, to avoid its contact with the ladder rungs 23, 23A and roof 210 to allow the carriage 12 to roll down the roof and the ladder. This is accomplished by means of a brake deck latch 69 positioned below the carriage deck 27B. Raising the carriage bar 52 for engagement in the deck latch 69 allows the carriage 12 to be rolled down the ladder and/or roof and also identifies to a user that the brake assemblies 50 and 58 are disengaged.

Figure 4:
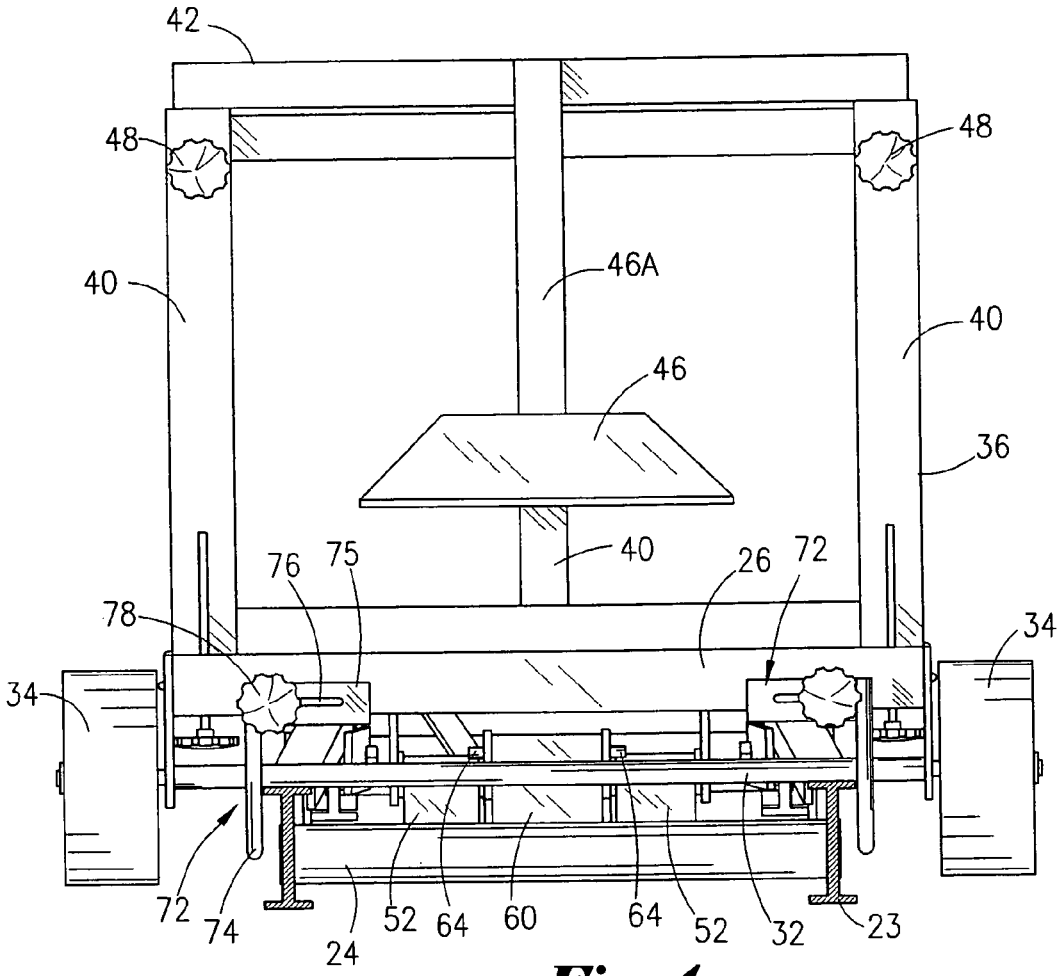
FIG. 4 is an end view of the ladder hoist carriage on a ladder.

In FIG. 4, an end view of the carriage 12, rail guide assemblies 72 are shown mounted to the carriage frame 26 to steer the carriage 12 as it rolls along the rails 23, 23A of the ladder 22. Each rail guide assembly 72 is comprised of a rail guide bar 74 positioned along the outside edges of the ladder rail 23. The position of the rail guide bar 74 with respect to the ladder rail 23 may be adjusted by means of the rail guide adjustment plate 75 having an adjustment slot 76 and rail guide adjustment screw 78. The adjustment of the rail guide assembly 72 allows for the carriage 12 to be adapted to fit the various widths of a selected ladder 22.

Figure 5:
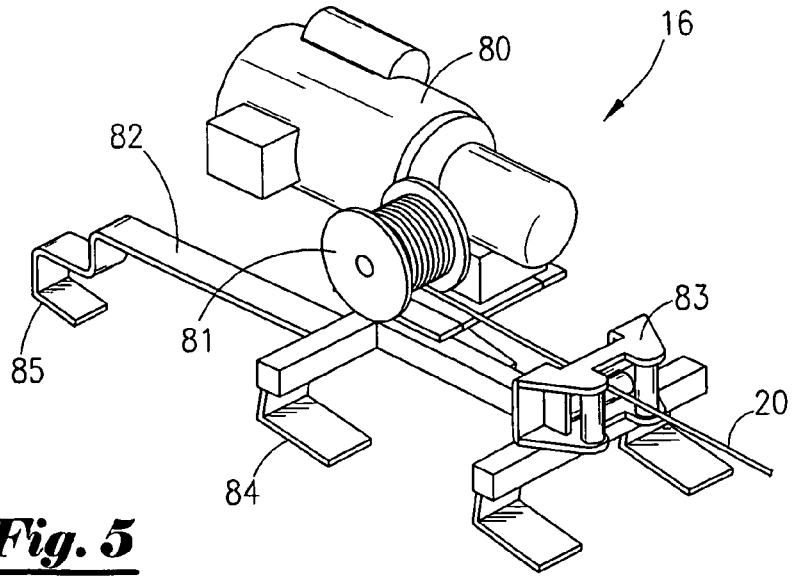
FIG. 5 is a side perspective view of the winch assembly.

The winch assembly 16 of the hoist assembly 14 is shown in FIG. 5. The winch assembly 16 is comprised of a winch 80 having a winch spool 81 and winch cable 20. The winch 80 may be electrically powered though other sources of power may also be employed. The winch 80 may be remotely controlled by mechanical or electronic means. The winch 80 is mounted on a winch support frame 82 having a cable guide 83. The winch support frame 82 has winch support roofing anchor stops 84 for supporting and securing the winch assembly 16 on the roof anchor 18. The anchor stops 84 are spaced apart so as to allow them to also be supported on the ladder rails 24 if lifting the carriage to the roof surface is not desired. Winch support frame 82 also has a carriage hitch 85 for attaching the winch assembly 16 on the carriage frame 26.

Figure 6:
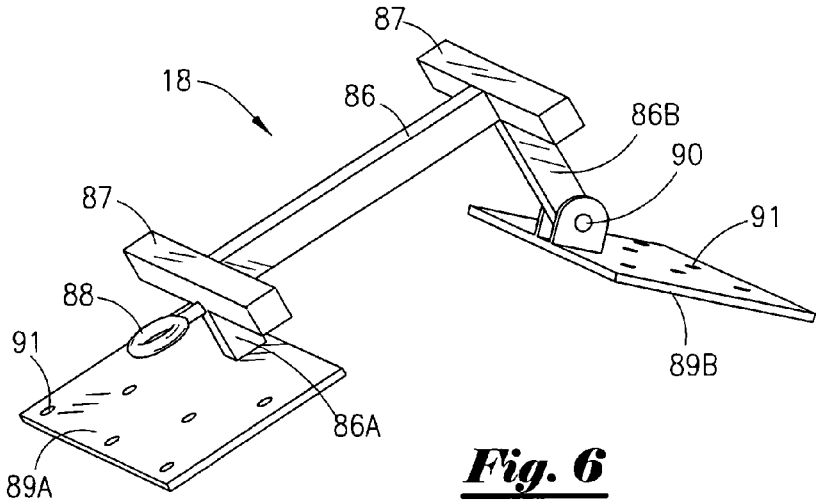
FIG. 6 is a perspective view of the roof anchor.

The roof anchor assembly 18 is shown in FIG. 6. The roof anchor assembly is comprised of a roof anchor bar 86 having vertically oriented roof anchor legs 86A and 86B positioned along the axis of the anchor bar 86. Transversely positioned anchor bars 87 are positioned on the anchor bar 86 for corresponding engagement with winch anchor stops 84. Roof anchor legs 86A, 86B have corresponding support pads 89A, 89B that have perforations serving as nail, spoke or screw guides 91. The spike guide 91 allows the anchor pads 89A, 89B to be secured to the roof surface 210 by nails or other means. The roof anchor leg 86B is somewhat longer than roof leg 86A to allow it to engage the roof surface on the opposite side of the roof ridgeline. The roof anchor leg 86B is pivotally attached by means of roof anchor leg bearing 90 to the roof support pad 89B to facilitate its alignment with the roof surface. While the roof anchor 18 may be utilized without the use of nailing the pads to the roof surface, such nailing allows a further measure of safety for the user.

Figure 7:
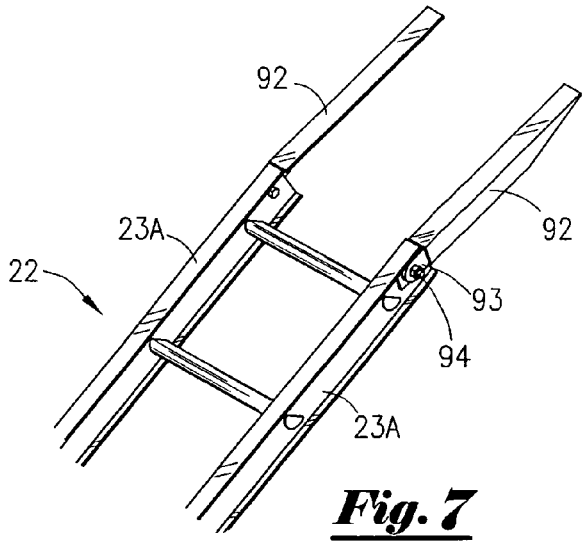
FIG. 7 is a perspective view of the roof eave guide bar.

FIG. 7 shows an adaptor piece for a typical extension ladder 22 to more readily allow the carriage 22 to be moved from the ladder 22 onto the roof 210. This is accomplished by means of attaching an eave guide bar 92 to the ends of the ladder rails 23 or 23A, as may be the case. Each eave guide bar 92 is pivotally attached to the ladder rails 23A, as shown in FIG. 7, by means of an attachment tab 93 and a guide bar bolt 94. The pivotal attachment of the guide bar 92 allows for adjustment to roofs of various pitches or inclines.

Figure 8:
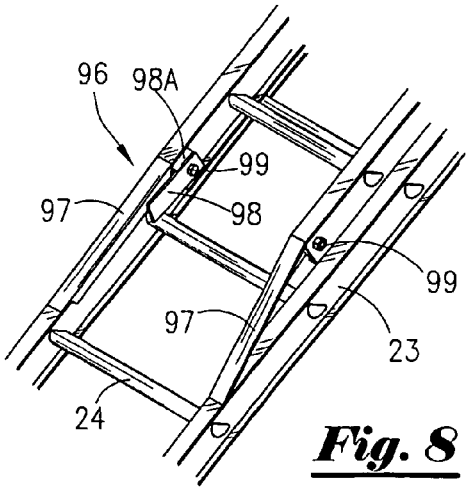
FIG. 8 is a perspective view of the ladder extension rail transition assembly.

FIG. 8 shows a rail transition assembly 96 for use in adapting a typical extension ladder to facilitate travel of the carriage 12 along the ladder rails 23 to ladder rails 23A. When the rails of the typical extension ladder are extended, there is a difference in rail height and in rail spacing width from one section of the ladder to the other. The ladder rail transition assembly 96 adapts the ladder rails to allow for a smooth transition in rail height and rail spacing width from one rail section to another. The rail transition assembly 96 is comprised of a ladder transition rail 97 secured to ladder extension rail 23A. The ladder transition rail rests on the top of ladder rail 23 as shown in FIG. 8. Transition rail 97 is pivotally attached to the transition rail 23A by means of transition support plate bolt 99 and transition rail filler plate 98A if required. The transition rail assembly 96 is thus adaptable to ladders of varying dimensions.

Referring again to FIG. 1, the hoisting assembly 10 is shown being prepared for an initial lift to the roof surface. To make such a lift, a user would climb the ladder 22 to the roof surface 210 and secure the anchor assembly 18 at the ridge of the roof. The cable 20 is then extended from the winch assembly 16, mounted on the carriage 12 by means of the winch carriage hitch 85, to the roof anchor assembly 18 and attached to the cable hitch 88. Engagement of the winch 80 of the winch assembly 16 will pull the carriage 12 by means of the cable 20 on the axle rollers 30, 32 along the ladder rails 23, 23A to the surface of the roof 210. When the carriage 12 reaches the roofs surface, the carriage 12 will roll along the roof 210 by means of the wheels 34. At this stage, the carriage 12 is held in place on the roof surface by means of wheel chocks or an intermediate support cable (not shown) temporarily placed between the carriage 12 and the anchor assembly 18. This allows for the winch assembly 16 to be removed from the carriage 12 and mounted on to the anchor assembly 18 by means of the winch supports 87 and winch anchor stops 84. The cable 20 is extended from the roof anchor 18 and winch assembly 16 and attached to the carriage hitch ring 71 of the carriage hitch bar 70.

To lower the carriage 12 from the roof surface to 210 and down the extension ladder 22, the break assemblies 50 and 58 are disengaged by means of lifting the deck 27B to expose the brake/carriage deck latch 69 and then lifting the ladder rung brake bar 52 and placing the brake rung stop 56 on the deck latch 69. This procedure will disengage the break assemblies 50 and 58, by holding the bars 52 and the claw 60 above the roof surface 210 and the ladder rungs 24, so that the unloaded carriage 12 may be rolled along the roof 210 and ladder 22. FIG. 9 shows a cross sectional view of the carriage brake assembly 50 disengaged by means of the brake/carriage brake latch 69 as described.

Figure 10:
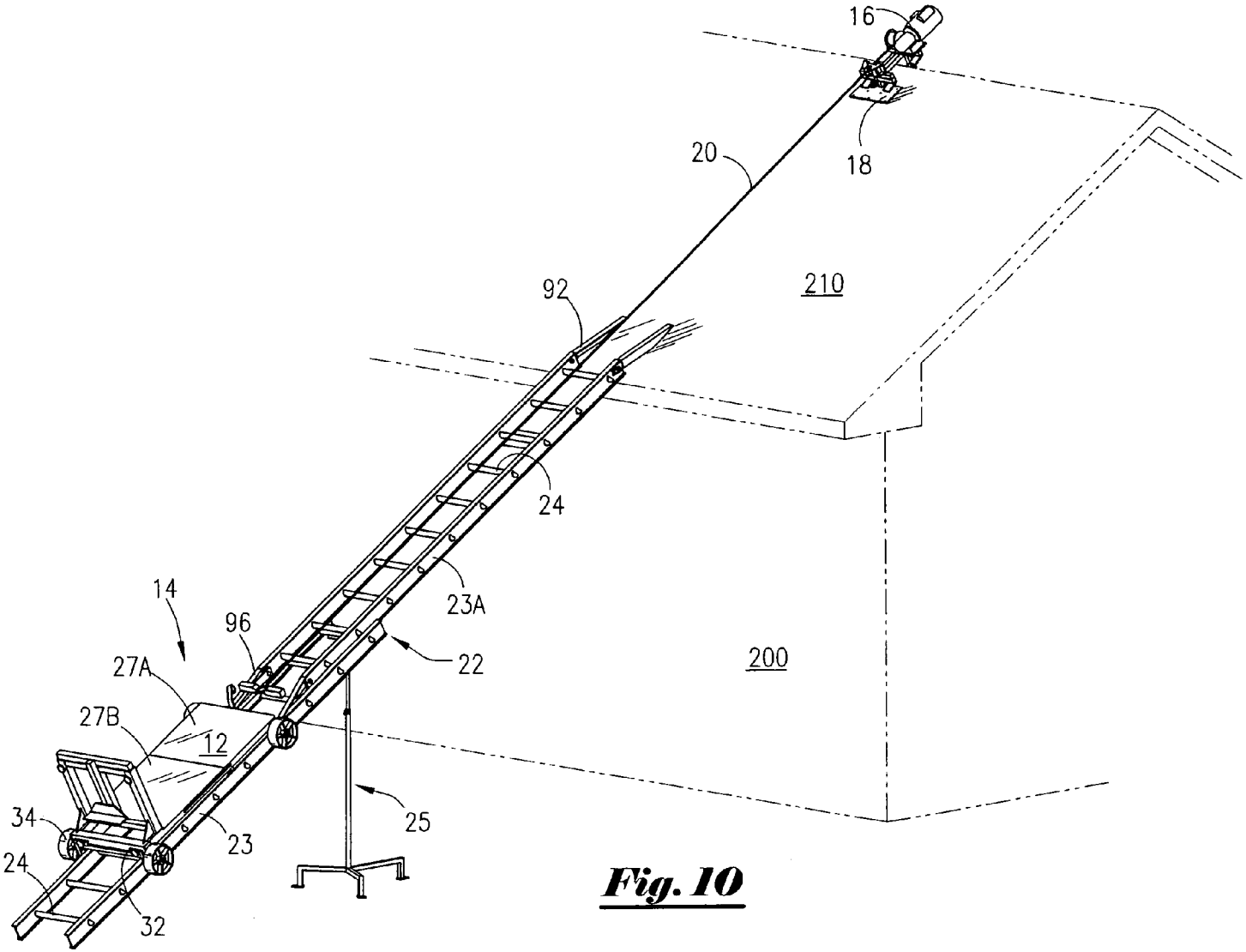
FIG. 10 is a perspective view of the ladder hoisting assembly ready for a hoist.

FIG. 10 shows the hoisting assembly 14 just prior to loading the deck 27 and hoisting the carriage 12 and the accompanying load. At this step in the process, the winch assembly 16 is mounted on the roof anchor assembly 18, the cable 20 is connected to the carriage hitch ring 71 of the carriage 12, and the carriage brake assembly 50 and the roof brake assembly 58 have been engaged by rotating and moving the lever 66 from its fixed position against the ladder hitch bar 70.

Figure 11:
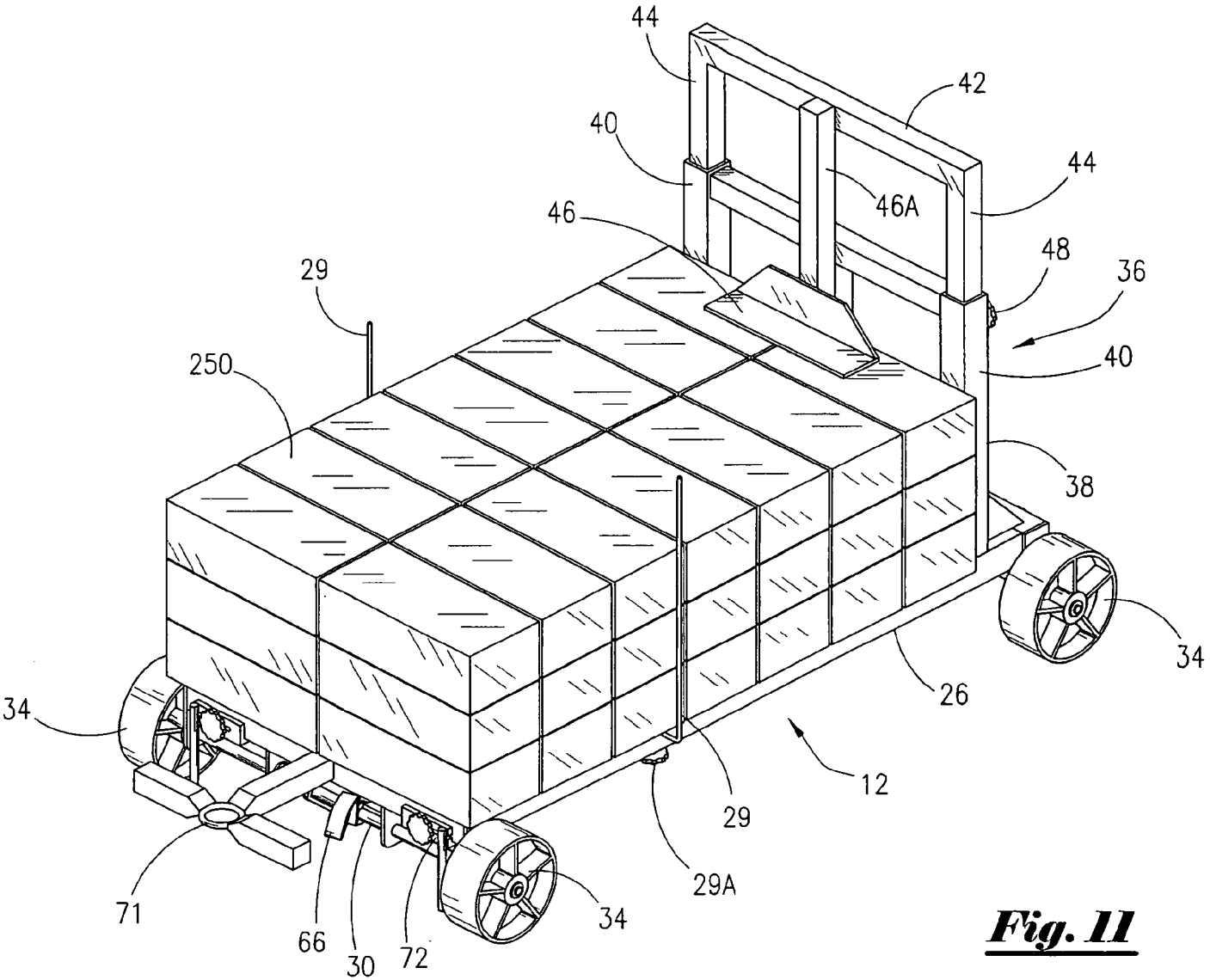
FIG. 11 is a perspective view of a load carriage.

FIG. 11 shows a loaded carriage 12 made ready for a lift. As shown the carriage 12 is loaded with boxes 250 representing roof materials, shingles or the like. These boxes 250 are supported on the carriage bed 27 and are prevented from shifting by means of the adjustable deck load support bars 29. The Boxes 250 stacked on the carriage deck 27 are further supported by the load stop brace 46. Load stop brace adjusts for the height of the boxes 250 as the upper load stop frame 42 has columns 44 which slide into the lower load stop columns 40 of the lower load stop frame 38 and the orientation can be reversed to allow the load support brace 46 to rest on top of the boxes 250. The upper load stop frame 42 can then be held in place by means of adjustment screws 48.

Figure 12:
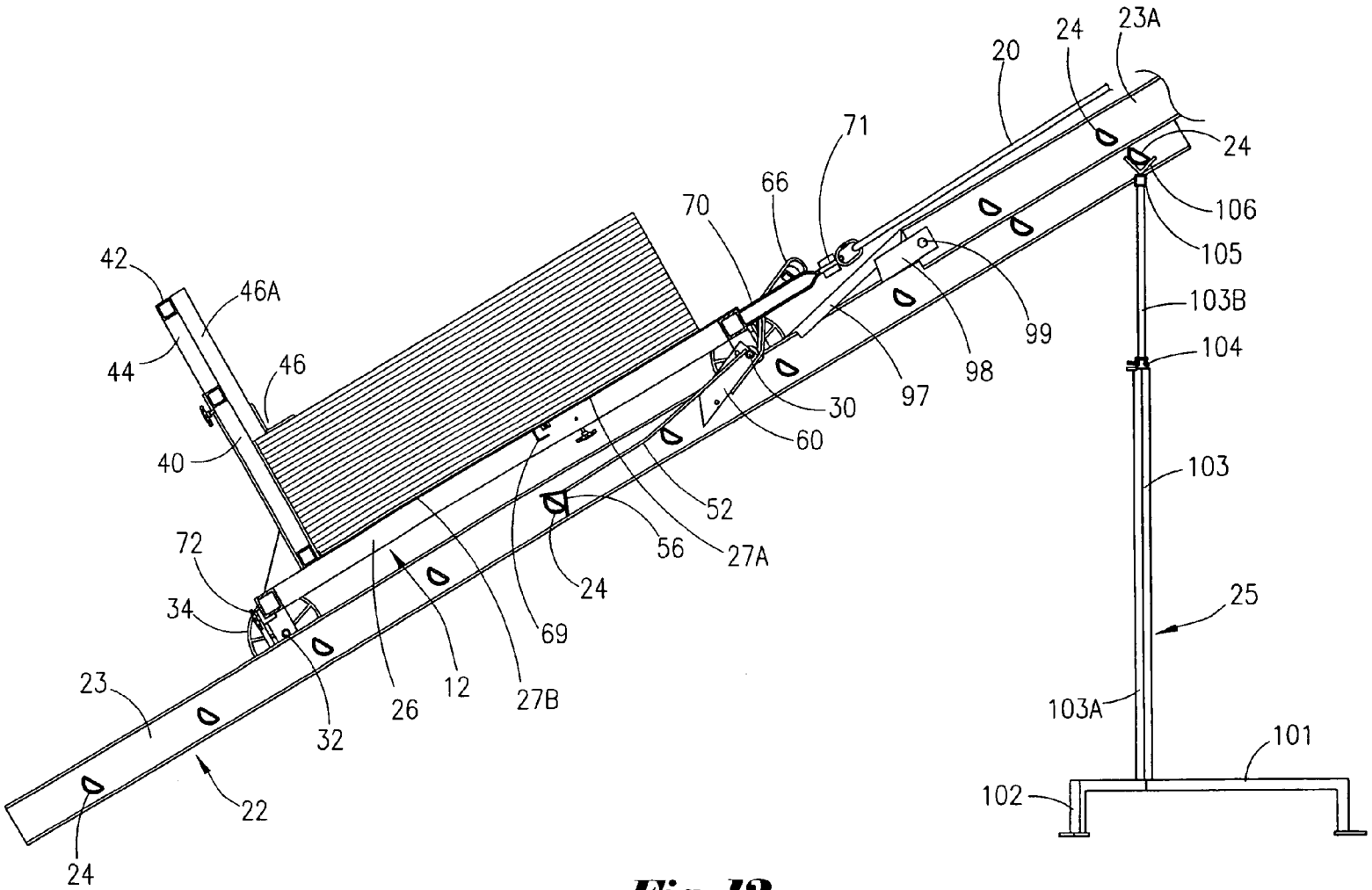
FIG. 12 is a cross sectional view of the hoisting apparatus during a hoist.

FIG. 12 shows a cross sectional view of a loaded carriage 12 in place on the ladder 22. As it can be seen, the carriage 12 is supported on axles 30 and 32 as it rolls along the rails 23 and 23A of the ladder 22. The ladder break assembly 50 is shown in its engaged position impede the backward movement of the carriage 12 on the ladder 22 but allow its forward movement up the ladder 22. Engagement of the winch 80 will pull the carriage 12 upward on the ladder 22 by means of the cable 20. As the carriage 12 moves forward and upward on the ladder 22, the pivoting claw 60 and the ladder rung brake bar 52 of the brake assemblies 50 and 58 glide over the ladder rungs 24. Any downward movement of the carriage 12 on the ladder 22 would provide for engagement of the rung stop 56 of the ladder rung brake bar 52 with a rung 24 to prevent further downward movement of the carriage 12.

FIG. 12 also shows the adjustable ladder support 25 in place to provide additional support to the ladder 22 as may be thought necessary on lifts made on longer ladder spans. The ladder support pole 103 has a lower support pole segment 103A and an upper telescopic support pole segment 103B that may be adjusted by means of support adjustment clamp 104 to place ladder rung cradle 106 in a desired position against a desired ladder rung 24.

Figure 13:
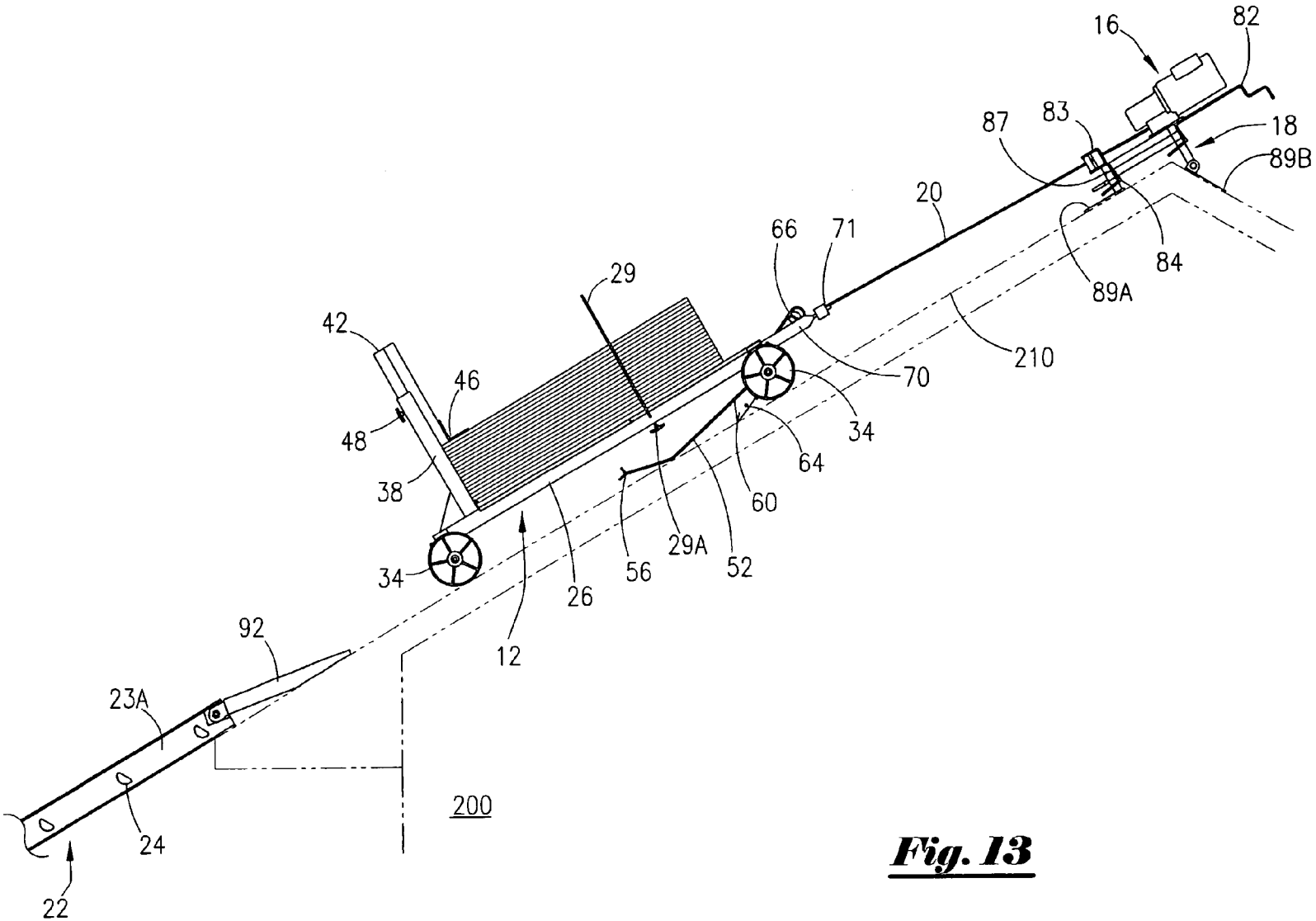
FIG. 13 is a side view of the hoisting assembly on a roof surface.

FIG. 13 shows the carriage 12 on a roof surface 210. At this stage the carriage 12 has transitioned from the ladder 22 to the roof surface 210 by means of the ladder roof guide bar 92. The wheels 34 allow the carriage 12 to be rolled along the roof surface by means of the cable 20 and winch assembly 16. Should the cart 12 roll downward on the roof surface due to a defect of the winch 80 or other reason, the roof brake claw 60 of the roof brake assembly 58 will engage and dig into the roof surface 210. Because the roof brake claw 60 pivots on roof brake bearing 62, the roof brake claw 60 is adaptable to different types of roof surfaces and roof pitches. The carriage ladder brake support pins 64 engage and hold the pivoting brake claw 60 in place to prevent over pivoting and rotation of the claw 60.

Figure 14:
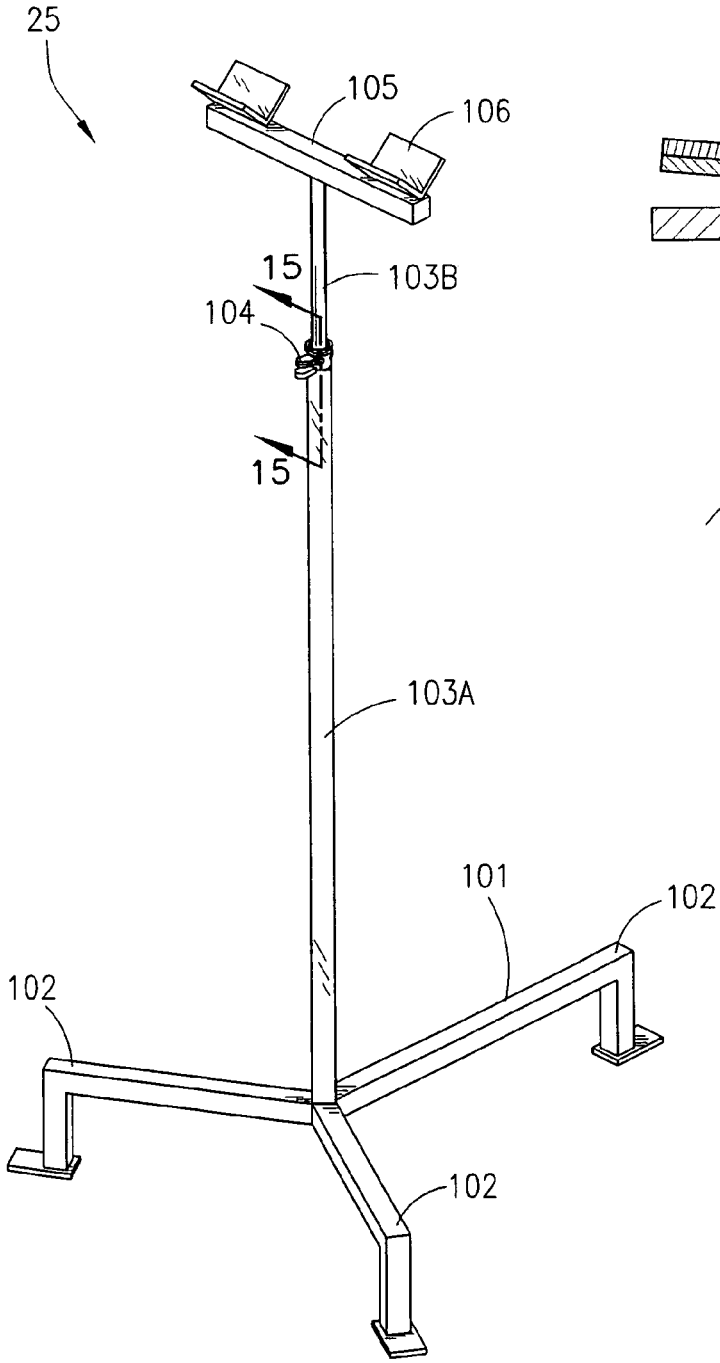
FIG. 14 is a perspective view of the ladder support.

FIG. 14 shows the telescopically adjustable ladder support 25. The ladder support 25 has a base 101 on which is vertically mounted a telescoping support pole 103. The telescoping support pole 103 is comprised of a lower pole 103A and an extendable upper support pole 103B that is telescopically adjustable in length by means of pole adjustment mechanism 104. The support pole 103B includes a rung support bar 105 to which is mounted lateral rung cradles 106. In use, the ladder support 25 is placed at a desired position under the ladder 22 and the pole 103B is extended as desired to place the rung cradle 106 under the desired ladder rung 24 to support the ladder 22 as may be desired.

Figure 15:
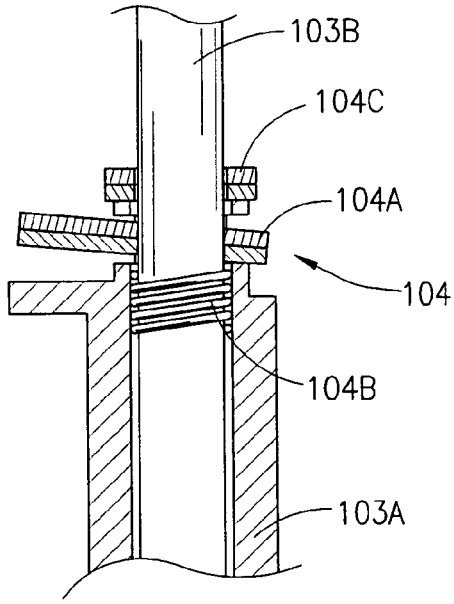
FIG. 15 is a cross sectional view of the ladder support adjustment clamp.

FIG. 15 shows a cross sectional detail of the ladder rung adjustment assembly 104. The ladder support adjustment assembly 104 is comprised of a ladder support adjustment clamp 104A and ladder support 104B that places the adjustment clap 104A in bias contact with support spring stop 104C. This allows for an infinite adjustment of the extension of ladder support pole 103B.

As can be seen from the illustrations, the carriage 12, in combination with the ladder 22, the roof ridge anchor 18, and the hoist assembly 16, provides for a self-contained hoisting assembly 14. This hoisting assembly 14 allows the winch 60 to be transported to the roof 210 on the carriage 12, detached from the carriage 12, and mounted on the roof anchor 18. The cable 20 may then be attached to the hitch ring 71 of the carriage 12 to allow the carriage 12 to be lowered down the roof and ladder 22. The user never has to manually bring the winch 60 to the roof surface 210 to facilitate a hoisting of a load. Once the carriage 12 is off the roof 210 and on the ground or a truck bed, the deck 27 may be loaded and pulled up the ladder 22 by means of the winch assembly 16. The process may be is repeated as necessary.

The carriage 12 may also be moved on the ladder 22 in the matter described above by placing the anchor stops 84 of the winch support frame 80 on the rungs 24 of the ladder and attaching the cable 20 to the carriage winch ring 71. This will allow loads to move up a ladder positioned against a wall without the use of the anchor assembly 18.

The foregoing is considered illustrative only of the principles of the invention. It may be apparent to those skilled in the art that numerous modifications and changes may be made in such details without departing from the spirit and principles of the invention.

I claim:

1. A method of moving materials to a roof surface comprising the steps of:

a. providing a ladder, said ladder having rungs and a pair of parallel side rails;

b. positioning said ladder against the edge of a roof;

c. providing an anchor means on said roof surface;

d. providing a carriage, said carriage having at least two axles and at least each of two pair of wheels;

e. providing a winch means, said winch means having means for extending and retracting a length of cable;

f. providing a length of cable attached to said winch;

g. attaching said cable to said anchor means;

h. removably attaching said winch means to said carriage;

i. loading said carriage;

j. retracting said length of cable whereby said carriage is rolled up said ladder on said axles and unto said roof surface on said wheels with said winch means;

k. detaching said winch means from said carriage and attaching said winch means to said anchor means;

l. detaching said cable from said anchor means and attaching said cable to said carriage; and m. extending said length of cable whereby said carriage is rolled off said roof surface on said wheels and onto and down said ladder on said axles.

2. The method as recited in claim 1 comprising the additional steps of:

a. providing said carriages with a first brake means, said first brake means having means for engaging said rungs of said ladder; and b. engaging said first brake means whereby movement of said carriage to said lower end of said ladder will be impeded by said means for engaging said ladder rungs.

3. The method as recited in claim 2 comprising the additional steps of:

a. providing said carriage with a second brake means, said second brake means having means for engaging said roof surface; and b. engaging said second brake means whereby movement of said carriage from said roof surface will be impeded by said means for engaging said roof surface.

4. The method as recited in claim 3 wherein, said ladder is an extension ladder.

5. The method as recited in claim 4 comprising the additional steps of:

a. supporting said ladder with a support column, said support column having a telescopically extendable upper section; and b. providing clamping means for infinite adjustment of said extendable upper section of said support column, said clamping means being spring biased against said extendable upper section of said support column.

6. A method for moving materials comprising the steps of:

a. providing an anchor means on said roof surface;

b. providing a carriage, said carriage having at least two axles and at least each of two pair of wheels;

c. providing a winch means, said winch means having means for extending and retracting a length of cable;

d. providing a length of cable attached to said winch;

e. attaching said cable to said anchor means;

f. removably attaching said winch means to said carriage;

g. positioning a ladder against an edge of a roof surface;

h. positioning a carriage on said ladder such that an axle of said carriage contacts a rail of said ladder;

i. engaging a first brake on said carriage by moving said carriage in a reverse direction, whereby movement of said carriage in a reverse direction on said ladder is impeded;

j. moving said carriage in a forward direction from a lower end of said ladder to an upper end of said ladder, and from said upper end of said ladder to said roof surface;

k. engaging a second brake on said carriage by moving said carriage in a reverse direction, whereby movement of said carriage in a reverse direction on said roof surface is impeded;

l. disengaging said first brake and said second brake; and m. moving said carriage in a reverse direction from said roof surface to said upper end of said ladder, and from said upper end of said ladder to said lower end of said ladder.

7. The method as recited in claim 6 wherein the step of engaging said first brake on said carriage further comprises contacting a rung of said ladder with said first brake.

8. The method as recited in claim 7 wherein the step of engaging said second brake on said carriage further comprises contacting said roof surface with said second brake.

9. The method as recited in claim 8 further comprising the additional step of disengaging said first brake and said second brake by moving a brake engagement bar to a disengaged position.

10. The method as recited in claim 9 further comprising the additional step of disengaging said first brake and said second brake by raising a deck of said carriage and supporting said deck with said first brake.

11. The method as recited in claim 10 further comprising the additional step of adjusting a rail guide on said carriage, whereby said rail guide is adjusted to accommodate said rails of said ladder.

12. The method as recited in claim 11 wherein the step of moving said carriage in a forward direction from a lower end of said ladder to an upper end of said ladder, and from said upper end of said ladder to said roof surface further comprises activating said winch.

13. The method as recited in claim 11 further comprising the additional steps of detaching said winch from said carriage and attaching said cable to said carriage.

14. The method as recited in claim 13 further comprising the additional step of attaching said winch to a roof anchor.

15. The method as recited in claim 14 further comprising the additional step of supporting said ladder with a support column.

* * * * *